US012070643B1

(12) United States Patent
Kim et al.

(10) Patent No.: US 12,070,643 B1
(45) Date of Patent: Aug. 27, 2024

(54) SUPPLEMENTAL RESISTANCE DEVICE FOR SELECTORIZED WEIGHT TRAINING MACHINES

(71) Applicant: Stack Bands LLC, Valencia, CA (US)

(72) Inventors: Alexander Kim, Valencia, CA (US); Robert Simerson, III, Stanton, CA (US)

(73) Assignee: Stack Bands, LLC, Valencia, CA (US)

( * ) Notice: Subject to any disclaimer, the term of this patent is extended or adjusted under 35 U.S.C. 154(b) by 0 days.

(21) Appl. No.: 18/529,238

(22) Filed: Dec. 5, 2023

Related U.S. Application Data

(60) Provisional application No. 63/518,437, filed on Aug. 9, 2023.

(51) Int. Cl.
*A63B 21/04* (2006.01)
*A63B 21/055* (2006.01)
*A63B 21/062* (2006.01)

(52) U.S. Cl.
CPC ..... *A63B 21/0428* (2013.01); *A63B 21/0557* (2013.01); *A63B 21/0628* (2015.10)

(58) Field of Classification Search
CPC ..... A63B 21/0428; A63B 21/0557; A63B 21/0628; A63B 21/00; A63B 21/00058; A63B 21/00061; A63B 21/00065; A63B 21/00069; A63B 21/023; A63B 21/00189; A63B 21/0407; A63B 21/0552
See application file for complete search history.

(56) References Cited

U.S. PATENT DOCUMENTS 4,610,449 A * 9/1986 Diercks, Jr. ..... A63B 21/0628 482/99
4,648,594 A 3/1987 Schleffendorf
5,556,362 A * 9/1996 Whipps ..... A63B 21/0628 482/97
6,174,265 B1 * 1/2001 Alessandri ..... A63B 21/063 482/99
D456,865 S * 5/2002 Caporali ..... 482/98
(Continued)

OTHER PUBLICATIONS

"Force USA G20 Weight Stack Mini-Band Pegs AKA "Versa Pegs"," published Feb. 21, 2021, YouTube video: https://baresteelequipment.com/collections/stacked-weight-pin/products/10mm-band-pin, by Stevie Richards Fitness (Year: 2021).*
(Continued)

*Primary Examiner* — Andrew S Lo
(74) *Attorney, Agent, or Firm* — Boon Intellectual Property Law, PLLC; Brian S. Bon

(57) ABSTRACT

A supplemental resistance device attachable as an accessory to the weight stacks of weight stack exercise machines to reduce or eliminate the unweighting effects of changes in acceleration at the top of the lift and friction losses during the downward phase of the lift. The supplemental resistance device comprises pins for insertion at two different levels of a weight stack, plus an elongatable resistance mechanism affixed between the pins which supplements the resistance provided by the weight stack as the two different levels of the weight stack are separated from one another. The supplemental resistance device maintains a more consistent load on the muscles during the full cycle of each lift on a weight stack exercise machine.

9 Claims, 6 Drawing Sheets

(56) References Cited

U.S. PATENT DOCUMENTS 7,316,638 B1 * 1/2008 Fabela ..... A63B 21/0628 482/99
7,507,190 B2 * 3/2009 Piane, Jr. ..... A63B 23/1209 482/99
8,187,155 B2 * 5/2012 Ooka ..... A63B 21/063 482/99
8,454,260 B2 * 6/2013 Wilcoxson ..... A63B 21/063 403/324
D740,897 S * 10/2015 Miltner ..... D21/694
9,192,800 B1 * 11/2015 Meyer ..... A63B 71/0054
9,242,134 B2 * 1/2016 Miltner ..... A63B 21/00069
9,327,158 B1 * 5/2016 Nelson ..... A63B 21/0442
9,468,791 B2 * 10/2016 Lojek ..... A63B 21/063
9,731,158 B1 * 8/2017 Lo ..... A63B 21/0628
11,794,059 B1 * 10/2023 KashKash ..... A63B 21/4007
2005/0176559 A1 * 8/2005 Carter ..... A63B 21/0628 482/94
2008/0242520 A1 * 10/2008 Hubbard ..... A63B 21/0628 482/98
2011/0028283 A1 * 2/2011 Webber ..... A63B 23/1245 482/99
2012/0208679 A1 * 8/2012 Webb ..... A63B 21/0628 482/98
2012/0322629 A1 * 12/2012 Webb ..... A63B 21/063 482/98
2015/0209609 A1 * 7/2015 Oteman ..... A63B 24/0087 482/8
2015/0224357 A1 * 8/2015 Lojek ..... A63B 21/0628 482/98
2015/0246258 A1 * 9/2015 Hockridge ..... A63B 21/156 482/99
2015/0251042 A1 * 9/2015 Smith ..... A63B 21/0628 482/98
2015/0367162 A1 * 12/2015 Mueller ..... A63B 21/154 482/94
2016/0001116 A1 * 1/2016 Prusaitis ..... A47B 13/088 482/142
2018/0104525 A1 * 4/2018 Naimo ..... A63B 21/063
2018/0147436 A1 * 5/2018 Ellis ..... A63B 21/0617
2018/0272173 A1 * 9/2018 Farias ..... A63B 1/00
2020/0070001 A1 * 3/2020 Malis ..... A63B 24/0062
2020/0114195 A1 * 4/2020 Henniger ..... A63B 21/154
2020/0289866 A1 * 9/2020 Gvoich ..... A63B 21/4043
2021/0283451 A1 * 9/2021 Gvoich ..... A63B 23/03541
2021/0402256 A1 * 12/2021 Huch ..... A63B 24/0062
2023/0067866 A1 * 3/2023 Henniger ..... A63B 21/154

OTHER PUBLICATIONS https://baresteelequipment.com/collections/stacked-weight-pin/products/10mm-super-stack-weight-pin (earliest sale date based on review: Mar. 11, 2023) (Year: 2023).*

Peltonen, "Neuromuscular Fatigue to Power Loading Using a Weight-Stack Device Fitted With or Without Additional Rubber Band Resistance,".
Journal of Strength and Conditioning Research, vol. 28(7), pp. 1802-1811, 2014, Finland.

* cited by examiner

Top View of
Ref. No. 613

Front View of
Ref. No. 633

SUPPLEMENTAL RESISTANCE DEVICE FOR SELECTORIZED WEIGHT TRAINING MACHINES

CROSS-REFERENCE TO RELATED APPLICATIONS

Priority is claimed in the application data sheet to the following patents or patent applications, each of which is expressly incorporated herein by reference in its entirety:

63/518,437

BACKGROUND

Field of the Art

The present invention is in the field of fitness and rehabilitation products, and more particularly in the area of accessories for exercise machines having weight stacks.

Discussion of the State of the Art

Exercise machines using weight stacks (also known as selectorized weight training machines or selectorized weight training equipment) are ubiquitous in the fitness and rehab field. Nearly every gym and physical therapy clinic has one or more of these machines. These machines provide resistance for weight lifting exercises by providing a stack of weights and a system of cables and pulleys, whereby insertion of a pin at a location in the stack of weights allows for selection of the amount of weight to be used during exercise.

A major problem with weight stack exercise machines is changes in resistance during exercise due to unweighting at the top of the lift and during the release phase of the lift caused by inertia of the weights and friction in the cables and pulleys of the machine. If the weights are accelerated quickly during the lift phase, they become free-floating at the top of the lift due to the change in acceleration from the upward direction to the downward direction. Further, during the release phase while the weights are traveling downward, the weights will feel lighter than during the lift phase when the force required to accelerate the weights upward is higher than their weight due to gravity, and the weights will have an effective downward force less than their weight due to gravity either because of downward acceleration or because friction in the cables and pulleys reduces the force felt at the handles. Thus, acceleration and deceleration of the weights during exercise provide inconsistent dynamic load on the muscles, an effect which is exacerbated the faster the exercise is performed. This inconsistency limits the speed at which exercise can be performed with proper form and load on the muscles. Further, the weight stacks can only be increased by increments of 5-10 lbs. depending on the machine which is too large an increment for certain users and certain types of exercise.

What is needed is means for reducing these inconsistent force effects of weight stack exercise machines.

SUMMARY

Accordingly, the inventor has conceived and reduced to practice, a supplemental resistance device attachable as an accessory to the weight stacks of weight stack exercise machines to reduce or eliminate the unweighting effects of changes in acceleration at the top of the lift and friction losses during the downward phase of the lift. The supplemental resistance device comprises pins for insertion at two different levels of a weight stack, plus an elongatable resistance mechanism affixed between the pins which supplements the resistance provided by the weight stack as the two different levels of the weight stack are separated from one another. The supplemental resistance device maintains a more consistent load on the muscles during the full cycle of each lift on a weight stack exercise machine.

According to a preferred embodiment, a supplemental resistance device for selectorized weight training machines is disclosed, comprising: a top pin assembly comprising a first pin and a first attachment point; a bottom pin assembly comprising a second pin and a second attachment point; and an elongatable resistance component having two ends and being configured to be attached at a first end to the first attachment point and at a second end to the second attachment point; wherein: insertion of the top pin assembly into a weight stack of a selectorized weight training machine provides a top anchor for the elongatable resistance component; insertion of the bottom pin assembly into the weight stack at a position below the inserted top pin assembly provides a bottom anchor for the elongatable resistance component; and attachment of the elongatable resistance component between the top pin assembly and the bottom pin assembly provides supplemental resistance to an amount of weight selected on the selectorized weight training machine.

According to an aspect of an embodiment, the first pin is of sufficient length to engage a selection bar or rod of the selectorized weight training machine such that insertion of the first pin into a first weight of the weight stack causes the first weight and all weights above the first weight to be selected as the amount of weight selected.

According to an aspect of an embodiment, the supplemental resistance device further comprises a separate selection pin, wherein the first pin is of insufficient length to engage a selection bar or rod of the selectorized weight training machine, and wherein insertion of the separate selection pin into a first weight of the weight stack below the first pin but above the second pin causes the first weight and all weights above the first weight to be selected as the amount of weight selected.

According to an aspect of an embodiment, the top pin assembly comprises a single-piece elongated pin of sufficient length to engage a selection bar or rod of the selectorized weight training machine and to provide the first attachment point, the first attachment point being a portion of the single-piece elongated pin extending outward from the front of the weight stack; and the bottom pin assembly comprises a single-piece elongated pin of insufficient length to engage the selection bar or rod of the selectorized weight training machine, but of sufficient length to provide the second attachment point, the second attachment point being a portion of the single-piece elongated pin extending outward from the front of the weight stack.

According to an aspect of an embodiment, the top pin assembly comprises a base plate, the first pin attached to the base plate, and the first attachment point attached to the base plate, wherein the first pin is of sufficient length to engage the selection bar or rod of the selectorized weight training machine, and the first attachment point is offset on the base plate from the longitudinal axis of the first pin; and the bottom pin assembly comprises a base plate, the second pin attached to the base plate, and the second attachment point attached to the base plate, wherein the second pin is of insufficient length to engage the selection bar or rod of the selectorized weight training machine, and the second attachment point is offset on the base plate from the longitudinal axis of the first pin.

According to an aspect of an embodiment, the top pin assembly comprises a base plate, a plurality of pins attached to the base plate comprising the first pin, and the first attachment point attached to the base plate, wherein the plurality of pins is configured to be inserted into the weight stack in a vertical orientation and at least one of the plurality of pins is of sufficient length to engage a selection bar or rod of the selectorized weight training machine, and the attachment point is a closed loop attached to the base plate in a horizontal orientation transverse to the vertical orientation of the pins; and the bottom pin assembly comprises a base plate, a plurality of pins attached to the base plate comprising the second pin, and the second attachment point attached to the base plate, wherein the plurality of pins is configured to be inserted into the weight stack in a vertical orientation and all of the plurality of pins are of insufficient length to engage the selection bar or rod of the selectorized weight training machine, and the second attachment point is a closed loop attached to the base plate in a horizontal orientation transverse to the vertical orientation of the pins.

According to an aspect of an embodiment, the elongatable resistance component comprises attachment hardware at both the first end and the second end, the attachment hardware being configured to be removable from the attachment points.

According to an aspect of an embodiment, the attachment hardware is drawn from the list of hooks, rings, and carabiners.

According to an aspect of an embodiment, the elongatable resistance component is a closed loop of elastomeric material or spring without attachment hardware wherein the closed loop of elastomeric material or spring is placed around the top and bottom attachment points According to an aspect of an embodiment, the elongatable resistance component is a piece of elastomeric material or spring without attachment hardware having a closed loop at each end wherein the closed loop at each one end of the elastomeric material or spring is placed around the top attachment point and the closed loop at the other end of the elastomeric material or spring is placed around the bottom attachment point.

BRIEF DESCRIPTION OF THE DRAWING FIGURES

DETAILED DESCRIPTION

Figure 1A:
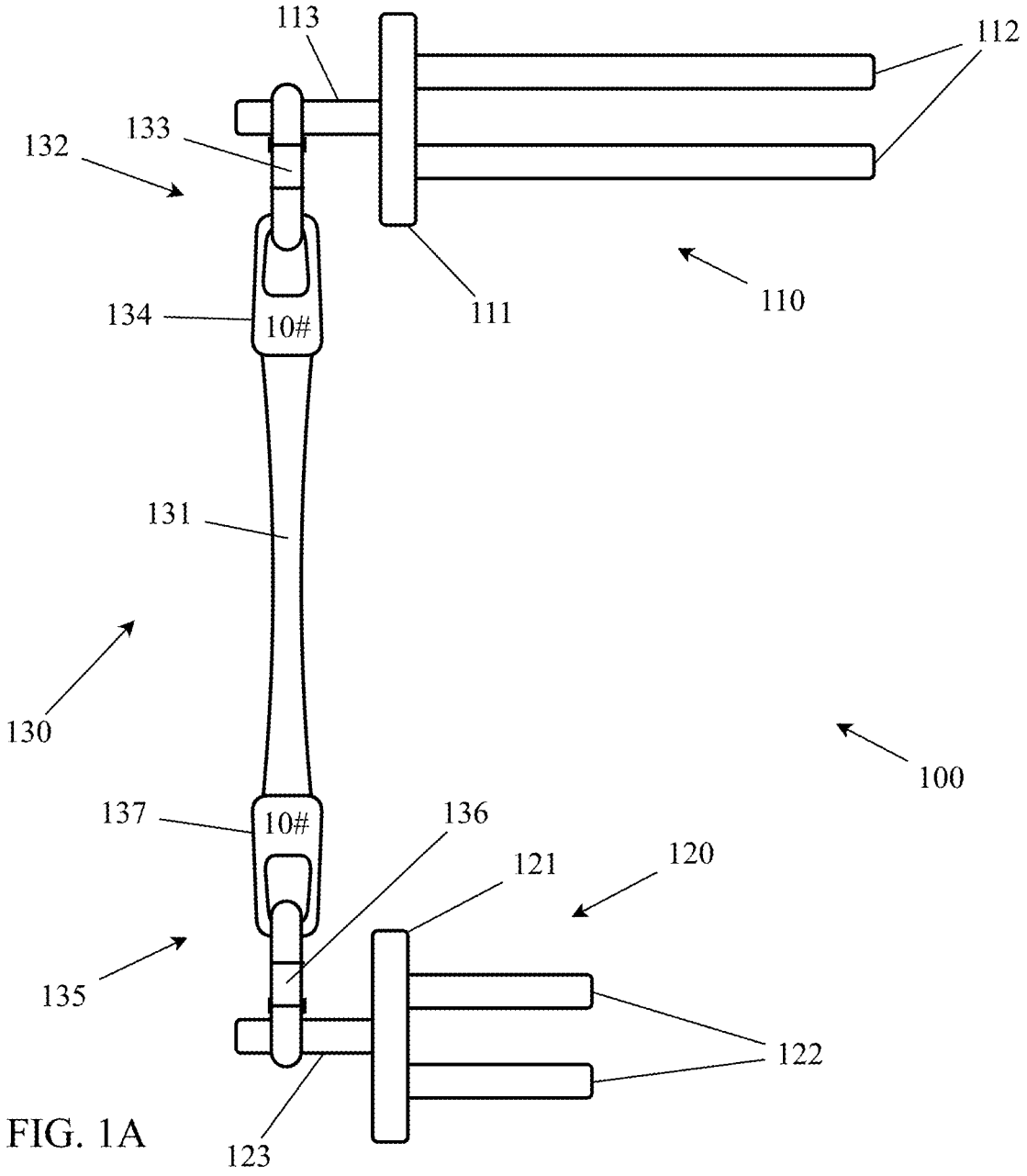
FIG. 1A is a diagram illustrating an exemplary supplemental resistance device for weight stacks having dual-pin pin assemblies.

The inventor has conceived, and reduced to practice, a supplemental resistance device attachable as an accessory to the weight stacks of weight stack exercise machines to reduce or eliminate the unweighting effects of changes in acceleration at the top of the lift and friction losses during the downward phase of the lift. The supplemental resistance device comprises pins for insertion at two different levels of a weight stack, plus an elongatable resistance mechanism affixed between the pins which supplements the resistance provided by the weight stack as the two different levels of the weight stack are separated from one another. The supplemental resistance device maintains a more consistent load on the muscles during the full cycle of each lift on a weight stack exercise machine.

A major problem with weight stack exercise machines is changes in resistance during exercise due to unweighting at the top of the lift and during the release phase of the lift caused by inertia of the weights and friction in the cables and pulleys of the machine. If the weights are accelerated quickly during the lift phase, they become free-floating at the top of the lift due to the change in acceleration from the upward direction to the downward direction. Further, during the release phase while the weights are traveling downward, the weights will feel lighter than during the lift phase when the force required to accelerate the weights upward is higher than their weight due to gravity, and the weights will have an effective downward force less than their weight due to gravity either because of downward acceleration or because friction in the cables and pulleys reduces the force felt at the handles. Thus, acceleration and deceleration of the weights during exercise provide inconsistent dynamic load on the muscles, an effect which is exacerbated the faster the exercise is performed. This inconsistency limits the speed at which exercise can be performed with proper form and load on the muscles. Further, the weight stacks can only be increased by increments of 5-10 lbs. depending on the machine which is too large an increment for certain users and certain types of exercise.

The supplemental resistance device for selectorized weight training machines remedies these deficiencies. By providing additional resistance that is not gravity-based, a supplemental resistance device as described herein reduces the effects of weighting and unweighting caused by inertia of the weights during acceleration and deceleration and by friction in the cables and pulleys of the machine itself. Selection of different types of elongatable resistance components will have different inertia-reducing or damping effects on the gravity-based weights. Metal springs, for example, will have a fairly constant effect as they elongate on the inertia of the gravity-based weights due to Hooke's law ($F=kx$) which states that the force, F, needed to extend a spring by a distance, x, is proportional to a constant k. Thus, springs increase in resistance force proportional to their elongation (e.g. a spring stretched twice as far will provide twice the resistance force), thus providing more resistance toward the top of the lift (both at the end of the upward phase of motion and the start of the downward phase of motion) when gravity-based weights tend to be lightest due to deceleration upward and the change to acceleration downward. Elastomeric bands (e.g., rubber, silicone, and other elastomeric materials) also largely follow Hooke's law, but don't respond quite as linearly as metal springs, so can vary from the ideal Hooke's law response under fast elongation and retraction. For example, rubber bands tend to have a higher-than-linear response during fast elongation and a lower-than-linear response during fast retraction. Thus, elastomeric bands of different materials can be selected as appropriate to the inertial damping desired for the gravity-based weights.

A benefit of the supplemental resistance device described herein is that it can be applied to a typical selectorized weight training machine without modification. Thus, a base load can be selected on the weight stack, with inertia-reducing or damping elongatable resistance components added in amounts preferred by the user. As multiple elongatable resistance components can be added as desired, the user can strike a preferred balance between gravity-based resistance and non-gravity-based resistance.

One or more different aspects may be described in the present application. Further, for one or more of the aspects described herein, numerous alternative arrangements may be described; it should be appreciated that these are presented for illustrative purposes only and are not limiting of the aspects contained herein or the claims presented herein in any way. One or more of the arrangements may be widely applicable to numerous aspects, as may be readily apparent from the disclosure. In general, arrangements are described in sufficient detail to enable those skilled in the art to practice one or more of the aspects, and it should be appreciated that other arrangements may be utilized and that structural, logical, software, electrical and other changes may be made without departing from the scope of the particular aspects. Particular features of one or more of the aspects described herein may be described with reference to one or more particular aspects or figures that form a part of the present disclosure, and in which are shown, by way of illustration, specific arrangements of one or more of the aspects. It should be appreciated, however, that such features are not limited to usage in the one or more particular aspects or figures with reference to which they are described. The present disclosure is neither a literal description of all arrangements of one or more of the aspects nor a listing of features of one or more of the aspects that must be present in all arrangements.

Headings of sections provided in this patent application and the title of this patent application are for convenience only, and are not to be taken as limiting the disclosure in any way.

Devices that are in communication with each other need not be in continuous communication with each other, unless expressly specified otherwise. In addition, devices that are in communication with each other may communicate directly or indirectly through one or more communication means or intermediaries, logical or physical.

A description of an aspect with several components in communication with each other does not imply that all such components are required. To the contrary, a variety of optional components may be described to illustrate a wide variety of possible aspects and in order to more fully illustrate one or more aspects. Similarly, although process steps, method steps, algorithms or the like may be described in a sequential order, such processes, methods and algorithms may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the aspects, and does not imply that the illustrated process is preferred. Also, steps are generally described once per aspect, but this does not mean they must occur once, or that they may only occur once each time a process, method, or algorithm is carried out or executed. Some steps may be omitted in some aspects or some occurrences, or some steps may be executed more than once in a given aspect or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other aspects need not include the device itself.

Techniques and mechanisms described or referenced herein will sometimes be described in singular form for clarity. However, it should be appreciated that particular aspects may include multiple iterations of a technique or multiple instantiations of a mechanism unless noted otherwise. Process descriptions or blocks in figures should be understood as representing modules, segments, or portions of code which include one or more executable instructions for implementing specific logical functions or steps in the process. Alternate implementations are included within the scope of various aspects in which, for example, functions may be executed out of order from that shown or discussed, including substantially concurrently or in reverse order, depending on the functionality involved, as would be understood by those having ordinary skill in the art.

The skilled person will be aware of a range of possible modifications of the various aspects described above. Accordingly, the present invention is defined by the claims and their equivalents.

Detailed Description of Drawing Figures

Figure 1B:
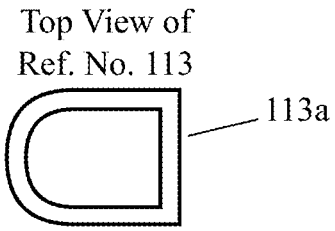
FIG. 1B shows a top view of an attachment point.
Figure 1C:
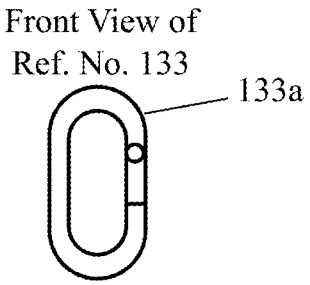
FIG. 1C shows a front view of a carabiner.

FIG. 1A is a diagram illustrating an exemplary supplemental resistance device for weight stacks having dual-pin pin assemblies. FIG. 1B shows a top view of an attachment point. FIG. 1C shows a front view of a carabiner.

In this exemplary embodiment, the supplemental resistance device 100 comprises a top pin assembly 110, a bottom pin assembly 120, and one or more elongatable resistance components 130. For clarity and simplicity, only a single elongatable resistance component 130 is shown in this example. In this embodiment, the top pin assembly has long pins that engage the selector bar or rod of the weight stack and the bottom pin assembly has short pins that do not engage the selector bar or rod of the weight stack. Thus, the weight selected on the weight stack is the weight into which the lower pin of the pair of pins 112 is placed.

The top pin assembly 110 functions both as a weight selector for the weight stack, and as the top anchor for the elongatable resistance component 130. The top pin assembly 110 comprises a base plate 111, a pair of pins 112, and an attachment point 113 for one end of the elongatable resistance component 130. The base plate 111 provides a base for attachment of the pins 112 and the attachment point 113. The pins 112 of the top pin assembly are of a length sufficient to engage the selection bar or rod which passes through the weight stack of a typical selectorized weight training machine. Thus, the weight selected on the weight stack is the weight into which the lower pin of the pair of pins 112 is placed. The pins 112 also provide purchase for the top pin assembly to act at the top anchor point for the elongatable resistance component 130. The pair of pins used in this configuration provides additional strength to the top pin assembly 110 and prevents rotation of the top pin assembly 110 when elongatable resistance components 130 are attached to the attachment point 113. Note that while a pair of pins is used in this example, any plurality of pins may be used (e.g., 3 pins, 4 pins, etc). Further, while both pins of the pair of pins 112 are shown in this example as being long enough to engage the selection bar or rod of the weight stack, only one of the pins needs to be that long and the other one can be short enough not to engage the selection bar or rod. Attachment point 113 is attached on a horizontal plane transverse to the vertical plane described by the pins. A top view of attachment point 113 is shown at 113*a*, being a D-shaped ring attached at the flat end to the base plate 111. The horizontal placement of attachment point 113 allows for multiple elongatable resistance components 130 to be placed about the circumference of the D-shaped ring. While the attachment points are shown here as being D-shaped, this is not meant to be limiting and other shapes allowing for attachment, both open and closed, may be used (e.g., circles, squares, open hooks, etc.).

The bottom pin assembly 120 functions both as the bottom anchor for the elongatable resistance component 130. The bottom pin assembly 120 comprises a base plate 121, a pair of pins 122, and an attachment point 123 for one end of the elongatable resistance component 130. The base plate 121 provides a base for attachment of the pins 122 and the attachment point 123. The pins 122 of the bottom pin assembly are too short to engage the selection bar or rod which passes through the weight stack of a typical selectorized weight training machine. Thus, the bottom pin assembly merely uses the weights above it as ballast and does not engage the selection bar or rod. The pins 122 provide purchase for the bottom pin assembly to act at the bottom anchor point for the elongatable resistance component 130. The pair of pins used in this configuration provides additional strength to the bottom pin assembly 120 and prevents rotation of the bottom pin assembly 120 when elongatable resistance components 130 are attached to the attachment point 123. Note that while a pair of pins is used in this example, any plurality of pins may be used (e.g., 3 pins, 4 pins, etc). Attachment point 123 is attached on a horizontal plane transverse to the vertical plane described by the pins. Attachment point 123 is a D-shaped ring attached at the flat end to the base plate 121. The horizontal placement of attachment point 123 allows for multiple elongatable resistance components 130 to be placed about the circumference of the D-shaped ring. While the attachment points are shown here as being D-shaped, this is not meant to be limiting and other shapes allowing for attachment, both open and closed, may be used (e.g., circles, squares, open hooks, etc.).

The elongatable resistance component 130 comprises two ends 132, 135, each with attachment hardware ideally having a means for removable attachment to its respective attachment point 113, 123. Here, the elongatable resistance component 130 comprises attachment hardware in the form of carabiners 133, 136 with a hinged gate for removable attachment, and nylon webbing end pieces 134, 137 with holes for attachment of carabiners 133, 136 securely attached to an elastomeric band 131. A side view of the carabiners is shown at 133*a*, having a roughly ovular shape with a hinged gate on one side. However, this diagram is not meant to be limiting, and the attachable hardware may be in the form of hooks, rings, loops, carabiners, or other types of attachment hardware 320. The elastomeric band 131 may be made of any elastomeric material (e.g., rubber, silicone, neoprene, etc.) having suitable clastic qualities for the application. The elongatable resistance component 130 may have a resistance rating indicating how much force must be applied to cause elongation. This resistance rating may be based on an initial force required to elongate, an average force required to elongate, a force at maximum elongation, or other suitable means of indicating a force. The resistance rating may indicate a gravity weight equivalent. Here, the resistance rating of elongatable resistance component 130 is shown as being the gravity weight equivalent of 10 pounds. Multiple elongatable resistances of the same or different resistance ratings may be used at the same time in any combination. Resistance ratings may be indicated by colors of some part of the elongatable resistance component (e.g., different colored elastomeric bands with yellow=10 lbs.; blue=20 lbs.; red=30 lbs.; green=40 lbs.; and black=50 lbs.). In an embodiment, the elongatable resistance component is a closed loop of elastomeric material (such as a rubber band) or spring without attachment hardware wherein the closed loop of elastomeric material or spring is placed around the top and bottom attachment points. In an embodiment, the elongatable resistance component is a piece of elastomeric material or spring without attachment hardware having a closed loop at each end wherein the closed loop at each one end of the elastomeric material or spring is placed around the top attachment point and the closed loop at the other end of the elastomeric material or spring is placed around the bottom attachment point.

Note that while this example uses elastomeric bands 131 for the elongatable portion of the elongatable resistance component 130, any elongatable material or device may be used. Examples of other suitable materials and devices are metal springs, plastic springs, elastomeric tubes, elastomeric sheets, elastomeric sheets rolled into tube shapes, leaf springs, and pistons having a fluid or gas inside for resistance.

Figure 2:
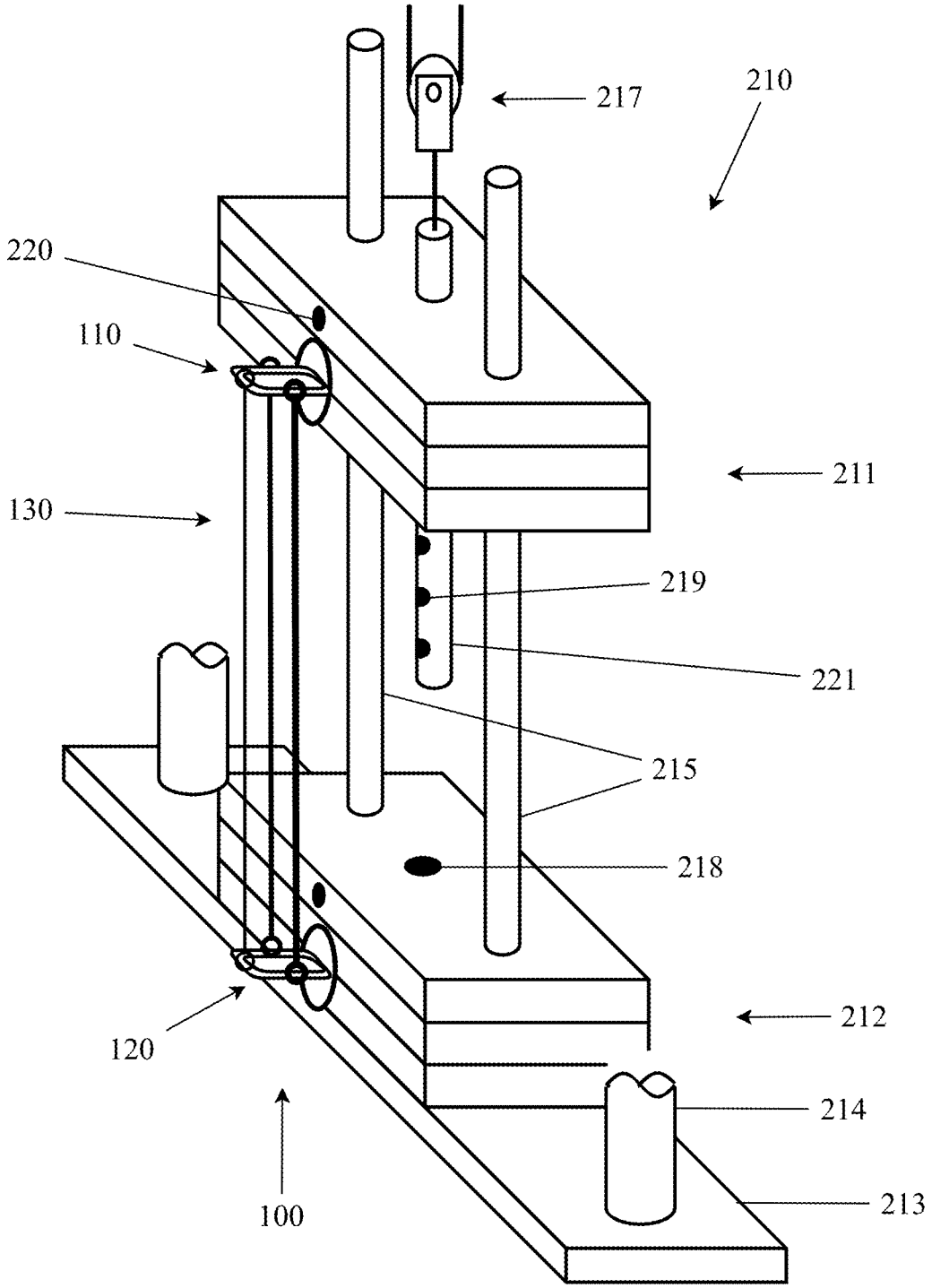
FIG. 2 is a diagram illustrating exemplary application of a supplemental resistance device to a weight stack.

FIG. 2 is a diagram illustrating exemplary application of a supplemental resistance device to a weight stack. The supplemental resistance device 100 shown in this diagram is the same embodiment as that shown in FIG. 1, and comprises a top pin assembly 110 and a bottom pin assembly 120, and one or more elongatable resistance components (shown here as simplified elastomeric bands with attached about the circumference of the attachment points 113, 123). The supplemental resistance device 100 is shown being used with a typical selectorized weight training machine 210 having a stack of rectangular weights 211, 212, mounted on a frame 213 (shown only in part) with vertical supports 214 (shown only in part) with vertical guide rods 215 to vertically guide the weights 211 being lifted, with a selector rod 221 having holes 219 for insertion of selection pins (not shown), the selector rod 219 passing through a hole 218 in the center of all of the weights and being lifted by a cable and pulley 217. When the selector rod 219 is fully lowered, the selection holes 219 will line up with the hole in the front of each weight 220, such that insertion of a pin into the hole 220 in the front of a given weight will cause that weight and all weights above it on the stack to be selected for use by affixing the weight to the selector rod 219 using the pin. This diagram shows a weight stack having six weights but a weight stack may have any number of such plates with 10 or more being common.

Here, the dual-pin top pin assembly 110 is shown as being inserted into the second and third plates from the top of a weight stack, causing the top three weights 211 of the weight stack to be selected for exercise. The dual-pin bottom pin assembly 120 is shown as being inserted into the fifth and sixth weights of the weight stack, causing the supplemental resistance device 100 to be anchored to the lower three weights of the weight stack 212. As exercise is performed, the upper three plates of the weight stack are lifted, causing elongation of the elongatable resistance components 130, which both provides additional force required to perform the lift and reduces inertial changes due to acceleration and deceleration of the weight stack. This provides a more consistent load on the muscles versus the "unweighting" of the weight stack that often occurs that the top of a lift due to changes in acceleration and friction of the cables and pulleys. An advantage of the horizontal orientation of the D-shaped attachment points 113, 123, is that there is room for a substantial number of elongatable resistance components 130 to be affixed about the circumference of attachment points 113, 123. While the attachment points are shown here as being D-shaped, this is not meant to be limiting and other shapes allowing for attachment, both open and closed, may be used (e.g., circles, squares, open hooks, etc.).

Figure 3A:
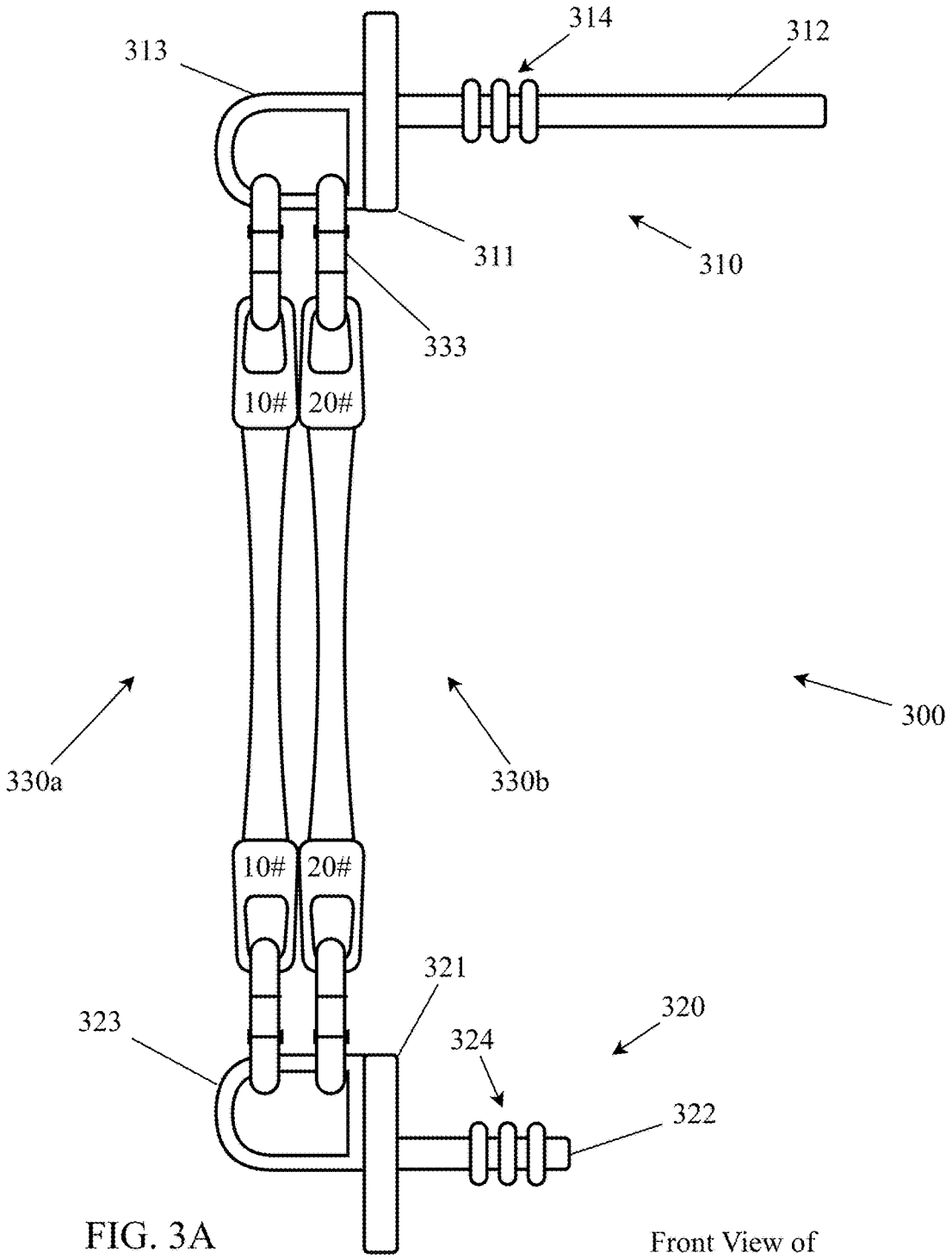
FIG. 3A is a diagram illustrating exemplary alternate embodiment of a supplemental resistance device for weight stacks having single-pin pin assemblies.
Figure 3B:
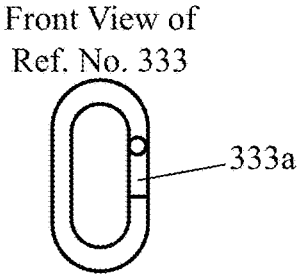
FIG. 3B shows a front view of a carabiner.

FIG. 3A is a diagram illustrating exemplary alternate embodiment of a supplemental resistance device for weight stacks having single-pin pin assemblies. FIG. 3B shows a front view of a carabiner.

In this embodiment of a supplemental resistance device 300, either the top pin assembly, or the bottom pin assembly, or both, have a curved, bent, angled, or otherwise off-center attachment point which keeps the pin assemblies from rotating even where a single pin is used. In this configuration, placing the curved, bent, angled, or otherwise off-center attachment point of the top pin assembly in a position facing the curved, bent, angled, or otherwise off-center attachment point of the bottom pin assembly prevents rotation of both pin assemblies.

Shown here are top and bottom pin assemblies 310, 320 having off-center D-shaped attachment points 313, 323, and a single pin 312, 322. While the pins 312, 322 of both pin assemblies 310, 320 are shown as being in the center of the base plate, the pin may in fact be located at any position along the base plate 311, 321 wherein the farther the pin is located from the attachment point, the stronger the resistance to turning (or overturning) of the pin assembly will be.

In this diagram, a pair of elongatable resistance components 330*a*, 330*b* are shown, although any number of elongatable resistance components may be used. In this embodiment, the top pin assembly 310 has a long pin that engages the selector bar or rod of the weight stack and the bottom pin assembly 320 has a short pin that does not engage the selector bar or rod of the weight stack. Thus, the weight selected on the weight stack is the weight into which the pin of the top pin assembly 310 is inserted.

The top pin assembly 310 functions both as a weight selector for the weight stack, and as the top anchor for the elongatable resistance components 330*a*, 330*b*. The top pin assembly 310 comprises a base plate 311, a pin 312, an attachment point 313 for one end of the elongatable resistance component 330, and a plurality of o-rings 314 to prevent the pin 312 from inadvertently sliding out of the selected weight. The base plate 311 provides a base for attachment of the pin 312 and the attachment point 313. The pin 312 of the top pin assembly is of a length sufficient to engage the selection bar or rod which passes through the weight stack of a typical selectorized weight training machine. Thus, the weight selected on the weight stack is the weight into which the pin 312 is inserted. The pin 312 also provides purchase for the top pin assembly to act at the top anchor point for the elongatable resistance component 330. Rotation of the top pin assembly 310 when elongatable resistance components 330 are attached is prevented by the off-center location of the attachment point 313 which will tend to keep the top pin assembly rotated toward the direction of force applied by the elongatable resistance components 330*a*, 330*b*. Attachment point 313 of this embodiment is a D-shaped ring attached at the flat end to the base plate 311. Multiple elongatable resistance components 330*a*, 330*b* may be placed along one edge of the D-shaped ring. While the attachment points are shown here as being D-shaped, this is not meant to be limiting and other shapes allowing for attachment, both open and closed, may be used (e.g., circles, squares, open hooks, etc.). Note that the o-rings are not meant to be limiting and other retention means may be used such as detent pins or ball lock pins.

The bottom pin assembly 320 functions as the bottom anchor for the elongatable resistance components 330*a*, 330*b*. The bottom pin assembly 320 comprises a base plate 321, a pin 322, an attachment point 313 for one end of the elongatable resistance component 330, and a plurality of o-rings 314 to prevent the pin 312 from inadvertently sliding out of the selected weight. The base plate 321 provides a base for attachment of the pin 322 and the attachment point 323. The pin 322 of the bottom pin assembly is too short to engage the selection bar or rod which passes through the weight stack of a typical selectorized weight training machine. Thus, the bottom pin assembly merely uses the weights above it as ballast and does not engage the selection bar or rod. The pin 322 provides purchase for the bottom pin assembly to act at the bottom anchor point for the elongatable resistance component 330. Rotation of the bottom pin assembly 320 when elongatable resistance components 330 are attached is prevented by the off-center location of the attachment point 323 which will tend to keep the bottom pin assembly rotated toward the direction of force applied by the elongatable resistance components 330*a*, 330*b*. Attachment point 323 of this embodiment is a D-shaped ring attached at the flat end to the base plate 321. Multiple elongatable resistance components 330*a*, 330*b* may be placed along one edge of the D-shaped ring. While the attachment points are shown here as being D-shaped, this is not meant to be limiting and other shapes allowing for attachment, both open and closed, may be used (e.g., circles, squares, open hooks, etc.). Note that the o-rings are not meant to be limiting and other retention means may be used such as detent pins or ball lock pins.

The elongatable resistance component 330 comprises two ends 332, 335, each ideally with a means for removable attachment to its respective attachment point 313, 323. Here, the elongatable resistance component 330 comprises carabiners 333, 336 with a hinged gate for removable attachment, and nylon webbing end pieces 334, 337 with holes for attachment of carabiners 333, 336 securely attached to an elastomeric band 331. A side view of the carabiners is shown at 333*a*, having a roughly ovular shape with a hinged gate on one side. However, this diagram is not meant to be limiting, and the attachable hardware may be in the form of hooks, rings, loops, carabiners, or other types of attachment hardware 320. The elastomeric band 331 may be made of any elastomeric material (e.g., rubber, silicone, neoprene, etc.) having suitable elastic qualities for the application. The elongatable resistance component 330 may have a resistance rating indicating how much force must be applied to cause elongation. This resistance rating may be based on an initial force required to elongate, an average force required to elongate, a force at maximum elongation, or other suitable means of indicating a force. The resistance rating may indicate a gravity weight equivalent. Here, the resistance rating of elongatable resistance component 330*a* is shown as being the gravity weight equivalent of 10 pounds, and the resistance rating of elongatable resistance component 330*a* is shown as being the gravity weight equivalent of 20 pounds. Multiple elongatable resistances of the same or different resistance ratings may be used at the same time in any combination. Resistance ratings may be indicated by colors of some part of the elongatable resistance component (e.g., different colored elastomeric bands with yellow=10 lbs.; blue=20 lbs.; red=30 lbs.; green=40 lbs.; and black=50 lbs.). In an embodiment, the elongatable resistance component is a closed loop of elastomeric material (such as a rubber band) or spring without attachment hardware wherein the closed loop of elastomeric material or spring is placed around the top and bottom attachment points. In an embodiment, the elongatable resistance component is a piece of elastomeric material or spring without attachment hardware having a closed loop at each end wherein the closed loop at each one end of the elastomeric material or spring is placed around the top attachment point and the closed loop at the other end of the elastomeric material or spring is placed around the bottom attachment point.

Note that while this example uses elastomeric bands for the elongatable portion of the elongatable resistance components 330*a*, 330*b*, any elongatable material or device may be used. Examples of other suitable materials and devices are metal springs, plastic springs, elastomeric tubes, elastomeric sheets, elastomeric sheets rolled into tube shapes, leaf springs, and pistons having a fluid or gas inside for resistance.

Figure 4:
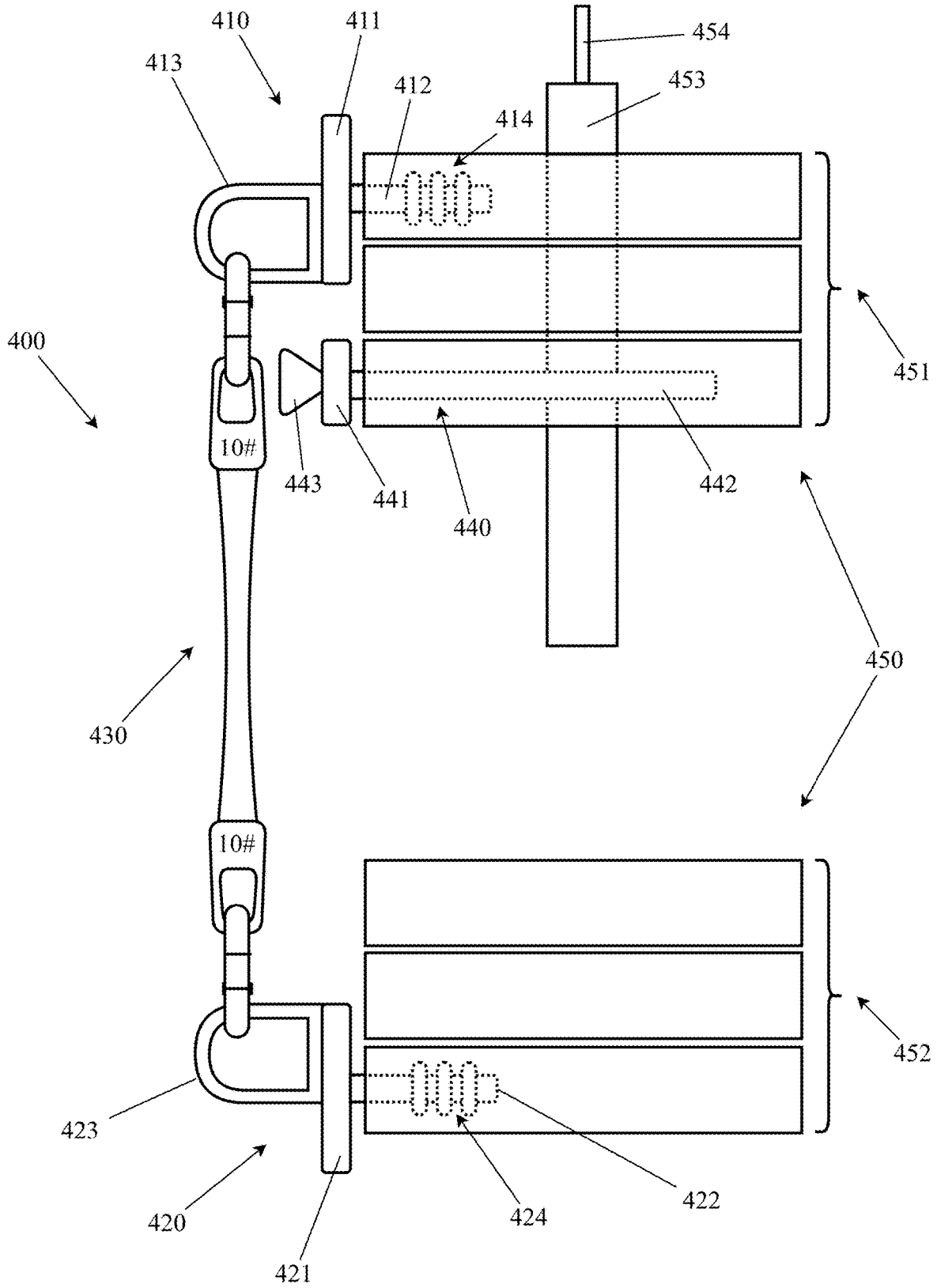
FIG. 4 is a diagram illustrating an exemplary alternate embodiment of a supplemental resistance device for weight stacks in which the weight stack's original pin is used for weight selection.

FIG. 4 is a diagram illustrating an exemplary alternate embodiment of a supplemental resistance device for weight stacks in which the weight stack's original pin is used for weight selection. According to this alternate embodiment, the supplemental resistance device 400 comprises a top pin assembly 410 functioning as a top anchor, a bottom pin assembly 420 functioning as a bottom anchor, and one or more elongatable resistance components 430 attached between the top pin assembly 410 and the bottom pin assembly 420.

The top pin assembly 410 comprises a base plate 411, a pin 412, a set of o-rings 414, and an attachment point (in this case an off-center D-shaped attachment point as described in previous embodiments) 413 for attaching resistance bands, each having functionality as described the previous embodiment. The pin 412 of this embodiment is too short to engage the selector rod 453 of the weight stack 450. The top pin assembly thus acts as an anchor for attachment of the elongatable resistance device 430, and may be placed anywhere in the top portion 451 of the weight stack 450 except for the lowest weight in that top portion 451. The weight stack's original pin 440 is used for selection of weights to be used 451 from the weight stack 450. The weight stack's original pin having a pin 442 of sufficient length to engage the selector rod 453 of the weight stack 450, a stopper 441 to stop insertion of the pin 442 at the proper depth, and a knob or handle 443 for insertion and removal of the weight pin.

The bottom pin assembly 420 comprises a base plate 421, a pin 422, a set of o-rings 424, and an attachment point (in this case an off-center D-shaped attachment point as described in previous embodiments) 423 for attaching resistance bands, each having functionality as described for the previous embodiment. The pin 422 of this embodiment is too short to engage the selector rod 453 of the weight stack 450. The bottom pin assembly thus acts as an anchor for attachment of the elongatable resistance device 430, and may be placed anywhere in the bottom portion 451 of the weight stack 450.

The elongatable resistance component 430 is substantially the same as described for reference numbers 130 in FIG. 1.

In this embodiment, both the top pin assembly and the bottom pin assembly have short pins 413, 423 that do not engage the selector bar or rod of the weight stack. The top pin assembly is inserted into one of the top plates 451 of the weight stack 450 as an anchor for one end of the resistance band 430, and the bottom pin assembly is inserted into one of the bottom plates 452 of the weight stack 450 (preferably at the bottom of the weight stack) as an anchor for the other end of the resistance band 430. The original pin selector 440 (comprising a stopper 441, a pin 442 of sufficient length to engage the selector rod of the weight stack, and a handle or knob 443) is used normally to select the weights, and is shown here as having selected the top plates 451 of the weight stack 450, while leaving the bottom plates 452 of the weight stack 450 not lifted.

Figure 5A:
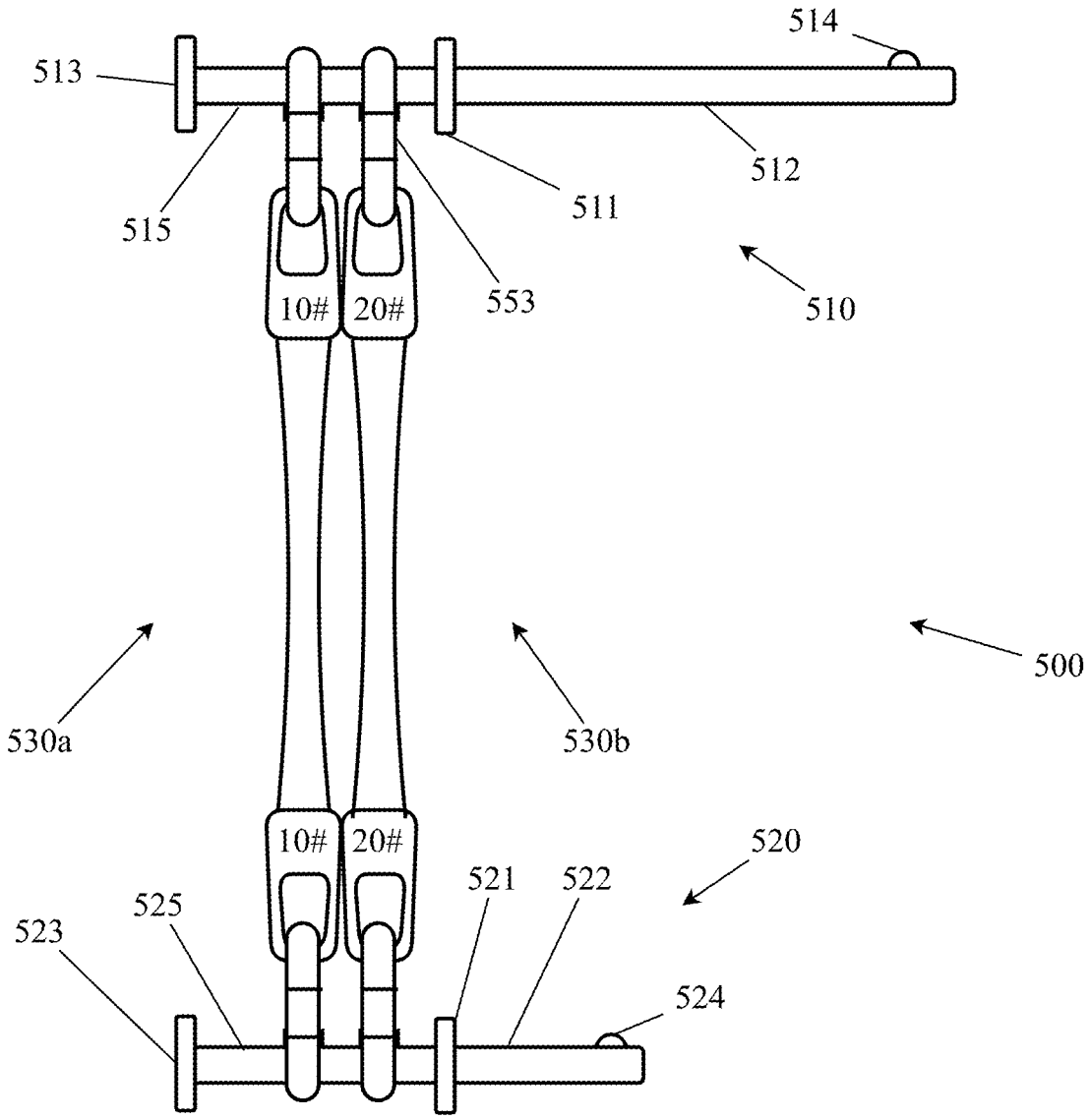
FIG. 5A is a diagram illustrating an exemplary alternate embodiment of a supplemental resistance device for weight stacks having pin assemblies comprising a single elongated pin.
Figure 5B:
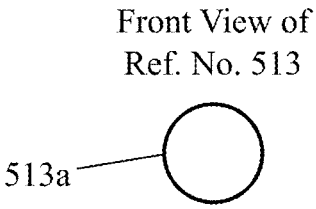
FIG. 5B shows a front view of an handle or knob.
Figure 5C:
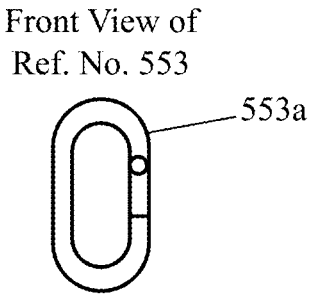
FIG. 5C shows a front view of a carabiner.

FIG. 5A is a diagram illustrating an exemplary alternate embodiment of a supplemental resistance device for weight stacks having pin assemblies comprising a single elongated pin. FIG. 5B shows a front view of an handle or knob. FIG. 5C shows a front view of a carabiner.

In this embodiment, the supplemental resistance device 500 comprises a top pin assembly 510 functioning as a top anchor and as a weight selector, a bottom pin assembly 520 functioning as a bottom anchor, and a pair of elongatable resistance components 530 attached between the top pin assembly 510 and the bottom pin assembly 520.

The top pin assembly 510 functions both as a weight selector for the weight stack, and as the top anchor for the elongatable resistance components 530*a*, 530*b*. The top pin assembly 510 comprises an insertion stopper 511, an elongated detent pin 512, a handle or knob 513, a detent ball 514, and an attachment point 515 for one end of the elongatable resistance components 530*a*, 530*b*. The stopper 511 stops insertion of the elongated detent pin 512 at the proper depth for engagement of the selector rod of the weight stack. The elongated detent pin 512 is a single-piece rod having sufficient length to both engage the selector rod and extend out from the front of the selected weight to provide the attachment point 515 for attachment of the elongatable resistance components 530*a*, 530*b*. The elongated detent pin 512 has a detent ball 514 to prevent the pin 312 from inadvertently sliding out of the selected weight. Thus, the weight selected on the weight stack is the weight into which the elongated detent pin 512 is inserted. The pin 512 also provides purchase for the top pin assembly to act at the top anchor point for the elongatable resistance component 530. Rotation of the top pin assembly 510 when elongatable resistance components 530 are attached is not an issue because the attachment point 513 is on the same axis as the rest of the elongated detent pin 510 so no torque is applied when elongated resistance components 530*a*, 530*b* are attached.

Attachment point 515 of this embodiment is simply a portion of elongated detent pin 512 extending out beyond stopper 511. Multiple elongatable resistance components 530*a*, 530*b* may be placed on attachment point 515. The handle or knob 513 also serves as a retention device to prevent the elongated resistance components 530*a*, 530*b* from slipping off the end of the attachment point 515 while in use. Note that the detent pin is not meant to be limiting and other retention means may be used or none at all. Further, the detent ball, 514, stopper 511 and handle 513, while shown in this embodiment, are not necessarily required to implement the supplemental resistance device.

The bottom pin assembly 520 functions both as the bottom anchor for the elongatable resistance components 530*a*, 530*b*. The bottom pin assembly 520 comprises an insertion stopper 521, an elongated detent pin 522, a handle or knob 523, a detent ball 524, and an attachment point 525 for one end of the elongatable resistance components 530*a*, 530*b*. The stopper 521 stops insertion of the elongated detent pin 522 at the proper depth for engagement of the selector rod of the weight stack. The elongated detent pin 522 is a single-piece rod too short to engage the selector rod, but long enough to extend out from the front of the selected weight to provide the attachment point 525 for attachment of the elongatable resistance components 530*a*, 530*b*. The elongated detent pin 522 has a detent ball 524 to prevent the pin 522 from inadvertently sliding out of the selected weight. Thus, the weight selected on the weight stack is the weight into which the elongated detent pin 522 is inserted. The pin 522 provides purchase for the bottom pin assembly to act as the top anchor point for the elongatable resistance components 530*a*, 530*b*. Rotation of the bottom pin assembly 520 when elongatable resistance components 530*a*, 530*b* are attached is not an issue because the attachment point 523 is on the same central longitudinal axis as the rest of the elongated detent pin 520 so no torque is applied when elongated resistance components 530*a*, 530*b* are attached. Attachment point 525 of this embodiment is simply a portion of elongated detent pin 522 extending out beyond stopper 521. Multiple elongatable resistance components 530*a*, 530*b* may be placed on attachment point 525. The handle or knob 523 also serves as a retention device to prevent the elongated resistance components 530*a*, 530*b* from slipping off the end of the attachment point 525 while in use. Note that the detent pin is not meant to be limiting and other retention means may be used or none at all. Further, the detent ball, 524, stopper 521 and handle 523, while shown in this embodiment, are not necessarily required to implement the supplemental resistance device.

The elongatable resistance components 530*a*, 530*b* are substantially the same as described for reference numbers 330*a*, 330*b* in FIG. 3.

Figure 6A:
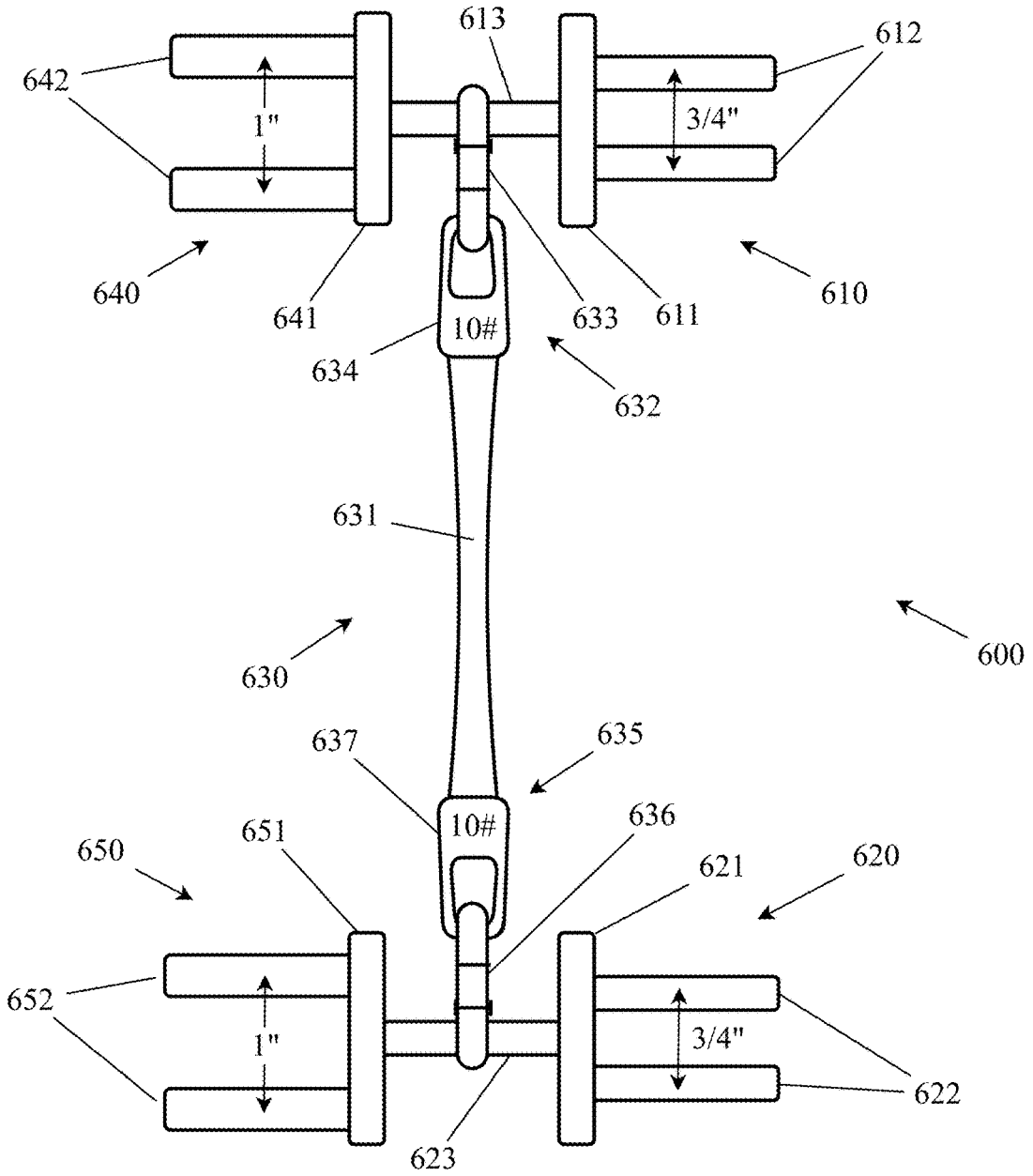
FIG. 6A is a diagram illustrating an exemplary alternate embodiment of a supplemental resistance device for weight stacks having dual-sided pin assemblies.

FIG. 6A is a diagram illustrating an exemplary alternate embodiment of a supplemental resistance device for weight stacks having dual-sided pin assemblies.

Figure 6B:
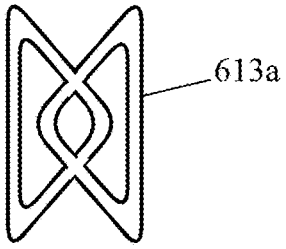
FIG. 6B shows a top view of an attachment point.

FIG. 6B shows a top view of an attachment point.

Figure 6C:
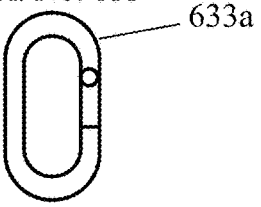
FIG. 6C shows a front view of a carabiner.

FIG. 6C shows a front view of a carabiner.

In this exemplary embodiment, the supplemental resistance device 600 comprises a dual-sided top pin assembly 610, 640, a dual-sided bottom pin assembly 620, 650, and one or more elongatable resistance components 630. For clarity and simplicity, only a single elongatable resistance component 630 is shown in this example. In this embodiment, both the dual-sided top pin assembly and the dual-sided bottom pin assembly have short pins that do not engage the selector bar or rod of the weight stack. A separate selector pin (e.g., the original pin used for the weight stack) is used to select the weight on the weight stack. In use, the dual-sided top pin assembly is placed above the separate selector pin and the dual-sided bottom pin assembly is placed below the separate selector pin.

The dual-sided top pin assembly 610, 640 functions as the top anchor for the elongatable resistance component 630. The dual-sided top pin assembly 610, 640 comprises a first base plate 611 with a first pair of pins 612, an attachment point 613 for one end of the elongatable resistance component 630, and a second base plate 641 with a second pair of pins 642. The base plates 611, 641 provide a base for attachment of the pins 612, 642 and the attachment point 613. The pins 612, 642 provide purchase for the dual-sided top pin assembly to act at the top anchor point for the elongatable resistance component 630. The pairs of pins 612, 642 used in this configuration provide additional strength to the dual-sided top pin assembly 610, 640 and prevent rotation of the dual-sided top pin assembly 610, 640 when elongatable resistance components 630 are attached to the attachment point 613. Note that while pairs of pins are used in this example, any plurality of pins may be used (e.g., 3 pins, 4 pins, etc). Attachment point 613 is attached on a horizontal plane transverse to the vertical plane described by the pins. A top view of attachment point 613 is shown at 613*a*, being a butterfly-shaped piece constructed of two overlapping triangles attached at the flat end to the base plate 611. The horizontal placement of attachment point 613 allows for multiple elongatable resistance components 630 to be placed about the butterfly shape. While the attachment points are shown here as being butterfly-shaped, this is not meant to be limiting and other shapes allowing for attachment, both open and closed, may be used (e.g., circles, squares, open hooks, etc.).

Note that there are two standard pin diameters and pin spacings in common use in the exercise industry: 8 mm pins with ¾" center-to-center spacing and 10 mm pins with 1" center-to-center spacing. This embodiment allows for compatibility with both standards in a single device. The first pair of pins 612 are 8 mm in diameter and have ¾" center-to-center spacing between them. The second pair of pins 642 are 10 mm in diameter and have 1" center-to-center spacing between them. The supplemental resistance device 600 can be used with either standard simply by using the appropriate pair of pins on the dual-sided top pin assembly 610, 640 and the dual-sided bottom pin assembly 620, 650. Spacings of other distances and other than center-to-center may be used in some embodiments.

The dual-sided bottom pin assembly 620, 650 functions as the top anchor for the elongatable resistance component 630. The dual-sided bottom pin assembly 620, 650 comprises a first base plate 621 with a first pair of pins 622, an attachment point 623 for one end of the elongatable resistance component 630, and a second base plate 651 with a second pair of pins 652. The base plates 621, 651 provide a base for attachment of the pins 622, 652 and the attachment point 623. The pins 622, 652 provide purchase for the dual-sided top pin assembly to act at the top anchor point for the elongatable resistance component 630. The pairs of pins 622, 652 used in this configuration provide additional strength to the dual-sided bottom pin assembly 620, 650 and prevent rotation of the dual-sided bottom pin assembly 620, 650 when elongatable resistance components 630 are attached to the attachment point 623. Note that while pairs of pins are used in this example, any plurality of pins may be used (e.g., 3 pins, 4 pins, etc). Attachment point 623 is attached on a horizontal plane transverse to the vertical plane described by the pins. A top view of attachment point

623 is shown at 623*a*, being a butterfly-shaped piece attached at the flat end to the base plate 621. The horizontal placement of attachment point 623 allows for multiple elongatable resistance components 630 to be placed about the circumference of the butterfly-shaped piece. While the attachment points are shown here as being butterfly-shaped, this is not meant to be limiting and other shapes allowing for attachment, both open and closed, may be used (e.g., circles, squares, open hooks, etc.).

Note that there are two standard pin diameters and pin spacings in common use in the exercise industry: 8 mm pins with ¾" spacing and 10 mm pins with 1" spacing. This embodiment allows for compatibility with both standards in a single device. The first pair of pins 612 are 8 mm in diameter and have ¾" spacing between them. The second pair of pins 652 are 10 mm in diameter and have 1" spacing between them. The supplemental resistance device 600 can be used with either standard simply by using the appropriate pair of pins on the dual-sided top pin assembly 610, 640 and the dual-sided bottom pin assembly 620, 650.

The elongatable resistance component 630 comprises two ends 632, 635, each with attachment hardware ideally having a means for removable attachment to its respective attachment point 613, 623. Here, the elongatable resistance component 630 comprises attachment hardware in the form of carabiners 633, 636 with a hinged gate for removable attachment, and nylon webbing end pieces 634, 637 with holes for attachment of carabiners 633, 636 securely attached to an elastomeric band 631. A side view of the carabiners is shown at 633*a*, having a roughly ovular shape with a hinged gate on one side. However, this diagram is not meant to be limiting, and the attachable hardware may be in the form of hooks, rings, loops, carabiners, or other types of attachment hardware 320. The elastomeric band 631 may be made of any elastomeric material (e.g., rubber, silicone, neoprene, etc.) having suitable elastic qualities for the application. The elongatable resistance component 630 may have a resistance rating indicating how much force must be applied to cause elongation. This resistance rating may be based on an initial force required to elongate, an average force required to elongate, a force at maximum elongation, or other suitable means of indicating a force. The resistance rating may indicate a gravity weight equivalent. Here, the resistance rating of elongatable resistance component 630 is shown as being the gravity weight equivalent of 10 pounds. Multiple elongatable resistances of the same or different resistance ratings may be used at the same time in any combination. Resistance ratings may be indicated by colors of some part of the elongatable resistance component (e.g., different colored elastomeric bands with yellow=10 lbs.; blue=20 lbs.; red=30 lbs.; green=40 lbs.; and black=50 lbs.). In an embodiment, the elongatable resistance component is a closed loop of elastomeric material (such as a rubber band) or spring without attachment hardware wherein the closed loop of elastomeric material or spring is placed around the top and bottom attachment points. In an embodiment, the elongatable resistance component is a piece of elastomeric material or spring without attachment hardware having a closed loop at each end wherein the closed loop at each one end of the elastomeric material or spring is placed around the top attachment point and the closed loop at the other end of the elastomeric material or spring is placed around the bottom attachment point.

Note that while this example uses elastomeric bands 631 for the elongatable portion of the elongatable resistance component 630, any elongatable material or device may be used. Examples of other suitable materials and devices are metal springs, plastic springs, elastomeric tubes, elastomeric sheets, elastomeric sheets rolled into tube shapes, leaf springs, and pistons having a fluid or gas inside for resistance.

What is claimed is:

1. A supplemental resistance device for selectorized weight training machines, comprising:

a dual-sided top pin assembly having:

a first side comprising a first base plate and a first plurality of pins attached to the first base plate, each pin of the first plurality of pins having a first diameter and having a first pin spacing distance between the pins;

a second side comprising a second base plate and a second plurality of pins attached to the second base plate, each pin of the second plurality of pins having a second diameter and having a second pin spacing distance between the pins;

a first attachment point for attachment of an elongatable resistance component, the first attachment point connecting the first base plate and the second base plate on the first and second sides of the top pin assembly;

a dual-sided bottom pin assembly having:

a first side comprising a third base plate and a third plurality of pins attached to the third base plate, each pin of the third plurality of pins having the first diameter and having the first pin spacing distance between the pins;

a second side comprising a fourth base plate and a fourth plurality of pins attached to the fourth base plate, each pin of the fourth plurality of pins having the second diameter and having the second pin spacing distance between the pins;

a second attachment point for attachment of an elongatable resistance component, the second attachment point connecting the third base plate and the fourth base plate on the first and second sides of the bottom pin assembly; and an elongatable resistance component configured to be attached between the first attachment point of the dual-sided top pin assembly and the second attachment point of the dual-sided bottom pin assembly;

wherein:

insertion of the top pin assembly into a weight stack of a selectorized weight training machine provides a top anchor for the elongatable resistance component;

insertion of the bottom pin assembly into the weight stack at a position below the inserted top pin assembly provides a bottom anchor for the elongatable resistance component; and attachment of the elongatable resistance component between the top pin assembly and the bottom pin assembly provides supplemental resistance to an amount of weight selected on the selectorized weight training machine.

2. The supplemental resistance device of claim 1, wherein a first pin on each side of the dual-sided bottom pin assembly is configured to engage a selection bar or rod of the selectorized weight training machine such that insertion of the first pin into a first weight of the weight stack causes the first weight and all weights above the first weight to be selected as the amount of weight selected.

3. The supplemental resistance device of claim 1, further comprising a separate selection pin, wherein the plurality of pins on both sides of both the dual-sided top pin assembly and the dual-sided bottom pin assembly are all configured not to engage a selection bar or rod of the selectorized weight training machine, and wherein insertion of the separate selection pin into a first weight of the weight stack below the dual-sided top pin assembly but above the dual-sided bottom pin assembly causes the first weight and all weights above the first weight to be selected as the amount of weight selected.

4. The supplemental resistance device of claim 2, wherein:

the first attachment point of the dual-sided top pin assembly is offset from a longitudinal axis of a first pin each side of the dual-sided top pin assembly; and the second attachment point of the dual-sided bottom pin assembly is offset from a longitudinal axis of the first pin on each side of the dual-sided bottom pin assembly.

5. The supplemental resistance device of claim 1, wherein:

the plurality of pins on each side of the dual-sided top pin assembly are configured to be inserted into the weight stack in a vertical orientation and the first attachment point of the dual-sided top pin assembly is a closed loop attached to the first base plate and the second base plate in a horizontal orientation transverse to the vertical orientation of the pins; and the plurality of pins on each side of the dual-sided bottom pin assembly are configured to be inserted into the weight stack in a vertical orientation, the attachment point of the dual-sided bottom pin assembly is a closed loop attached to the third base plate and the fourth base plate in a horizontal orientation transverse to the vertical orientation of the pins.

6. The supplemental resistance device of claim 1, wherein the elongatable resistance component comprises attachment hardware at both a first end and a second end of the elongatable resistance component, the attachment hardware being configured to be removable from the first attachment point and the second attachment point.

7. The supplemental resistance device of claim 6, wherein the attachment hardware comprises hooks, rings, and carabiners.

8. The supplemental resistance device of claim 1, wherein the elongatable resistance component is a closed loop of elastomeric material or spring without attachment hardware wherein the closed loop of elastomeric material or spring is placed around the respective attachment points of the dual-sided top pin assembly and the dual-sided bottom pin assembly.

9. The supplemental resistance device of claim 1, wherein the elongatable resistance component is a piece of elastomeric material or spring without attachment hardware having a closed loop at both a first end and a second end of the elastomeric material or spring, wherein the closed loop at the first end of the elastomeric material or spring is placed around the first attachment point of the dual-sided top pin assembly and the closed loop at the second end of the elastomeric material or spring is placed around the second attachment point of the dual-sided bottom pin assembly.

* * * * *